US006192853B1

(12) United States Patent
Natsume

(10) Patent No.: US 6,192,853 B1
(45) Date of Patent: Feb. 27, 2001

(54) OIL PUMP FOR FOUR CYCLE OUTBOARD MOTOR

(75) Inventor: Noriyuki Natsume, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/318,289

(22) Filed: May 25, 1999

(30) Foreign Application Priority Data

May 27, 1998 (JP) ..... 10-145767

(51) Int. Cl.[7] ..... F01M 11/00

(52) U.S. Cl. ..... 123/196 W; 123/196 R; 123/195 P

(58) Field of Search ..... 123/196 W, 196 R, 123/195 P; 440/88

(56) References Cited

U.S. PATENT DOCUMENTS 3,431,882 * 3/1969 Irgens ..... 123/195 P
4,372,258 * 2/1983 Iwai ..... 123/196 R
4,493,661 * 1/1985 Iwai ..... 123/195 P
4,766,859 * 8/1988 Miyaki et al. ..... 123/196 R
4,828,519 * 5/1989 Watanabe ..... 440/88
5,215,164 * 6/1993 Shibata ..... 123/196 A
5,687,686 * 11/1997 Takahashi ..... 123/195 P
5,701,872 * 12/1997 Kaku et al. ..... 123/495
5,704,819 * 1/1998 Isogawa ..... 440/88
5,873,755 * 2/1999 Takahashi et al. ..... 440/77
5,876,188 * 3/1999 Okamoto ..... 417/364
6,041,892 * 3/2000 Watanabe et al. ..... 123/196 W

* cited by examiner

*Primary Examiner*—Tony M. Argenbright
*Assistant Examiner*—Jason Benton
(74) *Attorney, Agent, or Firm*—Knobbe, Martens, Olson & Bear LLP

(57) ABSTRACT

An outboard motor oil pump driving arrangement wherein the oil pump is driven by a spline connection positioned between the engine crankshaft and the driveshaft. There is a spline connection also between the crankshaft and the driveshaft and this spline connection is spaced axially from the spline connection to the pump drive element with the splines being space from each other by a non-splined section so as to reduce stress risers and to make assembly and disassembly easy even if the parts are deformed.

17 Claims, 13 Drawing Sheets

OIL PUMP FOR FOUR CYCLE OUTBOARD MOTOR

BACKGROUND OF THE INVENTION

This invention relates to an oil pump for a four cycle outboard motor and more particularly to an improved driving arrangement for such an oil pump.

Although two cycle internal combustion engines have been the accepted powerplant for use in outboard motors for a long time, environmental conditions are dictating the use of four cycle engines. This presents some significant problems to the designer because of the more complicated nature of a four cycle engine when compared to a two cycle engine. One of the particular complicating factors with applying four cycle engines to outboard motors is the lubrication system for such engines.

Although the use of recirculating of lubrication systems provide much better environmental control than is possible with two cycle engines, there are significant problems with adapting conventional automotive type lubricating systems to outboard motor applications. One reason for this is the fact that the outboard motor crankshaft or engine output shaft rotates about a vertical rather than a horizontal axis. Thus, the crankcase chamber is not practical to be utilized as an oil reservoir for the engine.

Therefore, it has been the practice to provide an oil reservoir for the engine in the area below the engine and generally in the otherwise void area formed at the upper end of the driveshaft housing. This means, however, that the oil must be pumped from this reservoir to the engine lubricating system by an oil pump. The drive and location of these pumps is quite important. That is, the pump should be located in a manner that is driven easily off the engine and yet so that it is positioned in proximity to the oil pan or oil reservoir so as to minimize the length of flow paths, particularly on the inlet side of the pump.

Although one form of arrangement for driving the oil pump for a four cycle engine in an outboard motor has employed driving of the oil pump off of an overhead cam shaft of the engine, there are some potential disadvantages with this type of arrangement. Specifically, the cam shafts are driven at one-half crankshaft speed and hence, the oil pump will be driven slower than the crankshaft. This may not always provide the requisite amounts of lubricant for some types of engines.

There has been proposed, therefore, an arrangement for driving the oil pump from the engine output shaft at the interface where it joins the driveshaft for the propulsion unit. Several embodiments of such arrangements are shown in the copending application entitled "Oil Pump for Outboard Motor", Ser. No. 08/996,529 filed Dec. 23, 1997 in the name of Hitoshi Watanabe et al., which application is assigned to the assignee hereof.

With the arrangement shown in this copending patent application, the oil pump is driven off of the engine crankshaft at the area where it is joined to the driveshaft. This permits the oil pump to be positioned in close proximity to the underlying oil pan and greatly simplifies the construction. In addition, the oil inlet and outlet passages can be positioned free of the driving and driven components and thus permit a more leak-free environment.

One embodiment of that application utilizes the splined connection between the driveshaft and the engine output shaft as the driving arrangement for the oil pump. Although this has significant advantages, the construction shown in that application may present some problems in certain types of operations.

This may be understood best by reference to FIGS. 1–3 of this application which illustrate generally the arrangement shown in the embodiment of FIG. 16 of that application. This construction will now be described by reference to these figures which are basically cross-sectional views taken through the area at the upper portion of the driveshaft housing and the lower unit and the lower portion of the power head. As described below, FIG. 1 is a cross-sectional view taken through the oil pump in this area while FIG. 2 is an enlarged view of the area shown in FIG. 1 and FIG. 3 is a further enlarged view of the area encompassed by the circle 3 in FIG. 2.

As seen in these figures, the engine crankshaft 21 has a portion that protrudes below a lower face of the engine cylinder block, crankcase assembly 22. This portion of the crankshaft 21 is provided with a splined opening 23. A splined end 24 of a driveshaft 25 is received in and thus drivingly coupled to the engine crankshaft 21. The driveshaft 25 depends into the driveshaft housing and lower unit of the outboard motor for driving its propulsion device.

It should be seen that the splined portion 24 of the driveshaft 25 is substantially longer than the length of the crankshaft splines 23. This permits driving engagement with a pump driving element 26 of a gerotor type oil pump, indicated generally by the reference numeral 27 and mounted on top of a supporting plate 28 formed at the upper end of the driveshaft housing. This pump driving member 26 has a splined inner portion 29 so as to provide a driving relationship therewith. The outer portion of the driving member 26 drives the inner gear 31 of the gerotor type pump 27 which cooperates with a fixed outer gear 32 to provide the pumping action in a manner well known in the art.

As may be best seen in FIGS. 2 and 3, the arrangement is such that there must be a small clearance area z between the lower end of the crankshaft 21 and the upper end of the inner portion of the pump driving member 31. Thus, the splined portion 24 of the driveshaft 25 has a first part 33 which is engaged with the crankshaft splines 23 and a second part 34 that is engaged with the inner splines of the pump drive member 31 these being the splines 29. The driveshaft 24 is obviously subjected to varying and at times substantial torsional forces. This means that there will be stress raised areas WI and W2 at the ends of the splined connections between the crankshaft 21 and the pump driving member 31. Thus, there is a risk that a fracture or failure may occur in this area. Of course, this can be offset by making the diameters larger and the pieces larger, but this is obviously not desirable.

In addition to this problem, even if failure does not occur, a permanent deformation of the splines in the area z and specifically the splined portion 24 of the driveshaft 25 may become deformed and it may be difficult to disassemble the construction.

It is, therefore, a principal object of this invention to provide an improved oil pump drive arrangement suitable for use in an outboard motor.

It is a further object of this invention to provide an improved and simplified oil pump drive arrangement for an outboard motor of the type generally described and one in which stress risers and other problems associated therewith can be eliminated.

SUMMARY OF THE INVENTION

This invention is adapted to be embodied in an outboard motor oil pump and drive arrangement for a lubricating system of the engine that propels the water propulsion device of the outboard motor. The outboard motor has a powerhead that is comprised of a powering four cycle internal combustion engine and a surrounding protective cowling. A driveshaft housing and lower unit depends from the powerhead and contains the water propulsion device. The engine is positioned in the powerhead so that a crankshaft of the engine rotates about a vertically disposed axis. A driveshaft depends into the driveshaft housing and lower unit for driving the water propulsion device. The engine lubricating system includes an oil pan that is positioned below the engine. The oil pump is positioned below the engine and above the oil pan. The oil pump has a drive element for driving the oil pump. A first spline connection is formed between the crankshaft and the driveshaft for driving the driveshaft from the crankshaft. A second spline connection is provided between the crankshaft and the drive element for driving the oil pump from the crankshaft. The first and second spline connections comprise a pair of axially spaced apart splines formed on one of the crankshaft and the driveshaft and separated by a smaller diameter non-splined portion thereof.

DETAILED DESCRIPTION OF THE PREFERRED EMBODIMENT OF THE INVENTION

Figure 1:
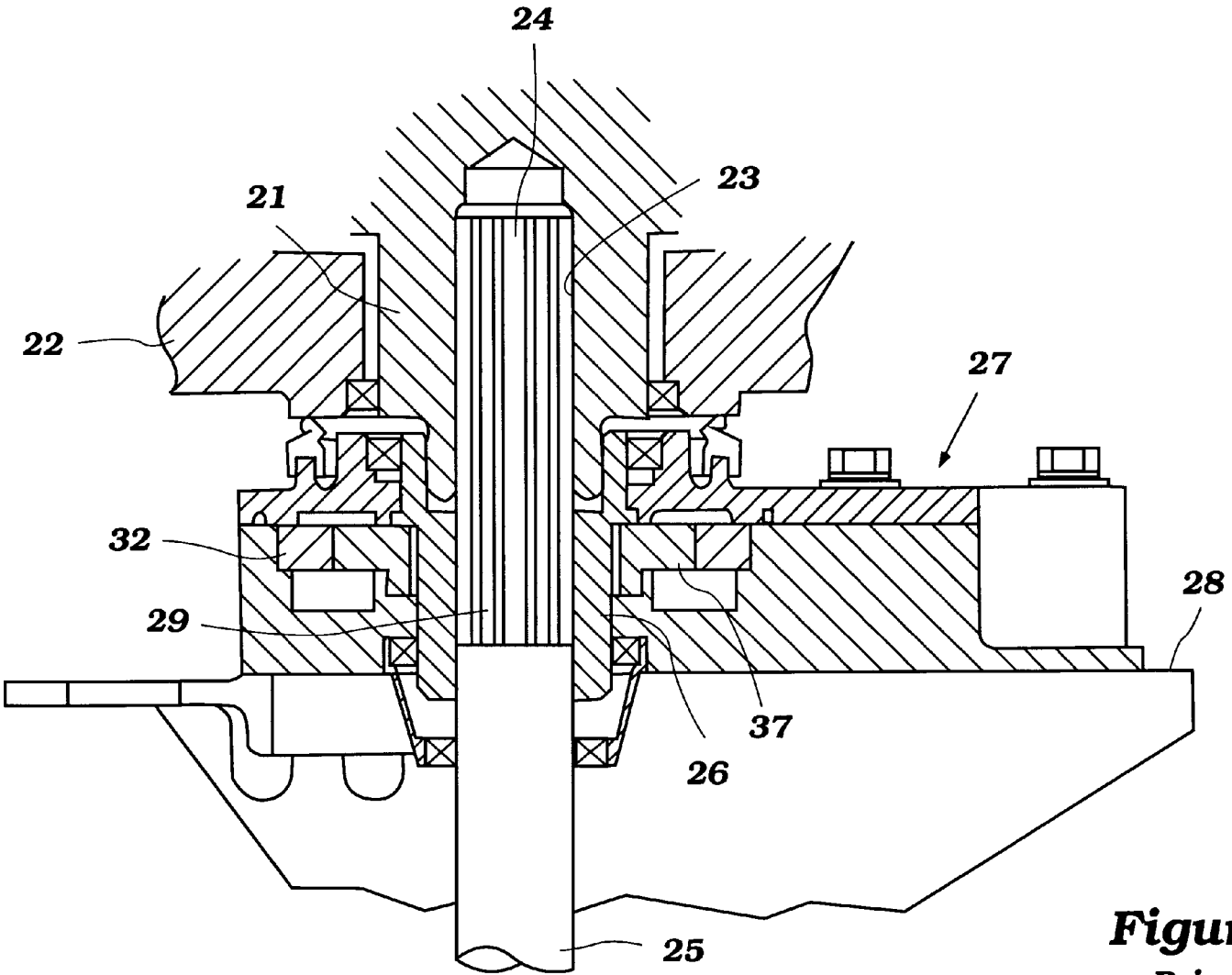
Figure 1 Prior Art
FIG. 1 (Prior Art) is an enlarged cross-sectional view taken through the connection between an engine crankshaft and a driveshaft of a prior art type of outboard motor construction and shows a driving connection therebetween an oil pump.
Figure 2:
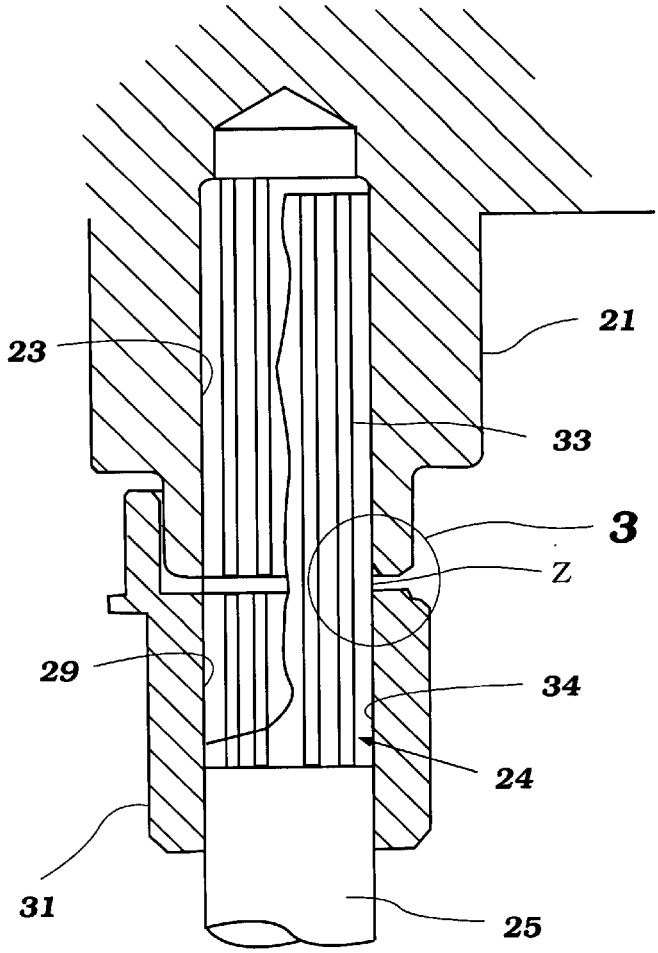
Figure 2 Prior Art
FIG. 2 (Prior Art) is an enlarged cross-sectional view showing the spline connections.
Figure 3:
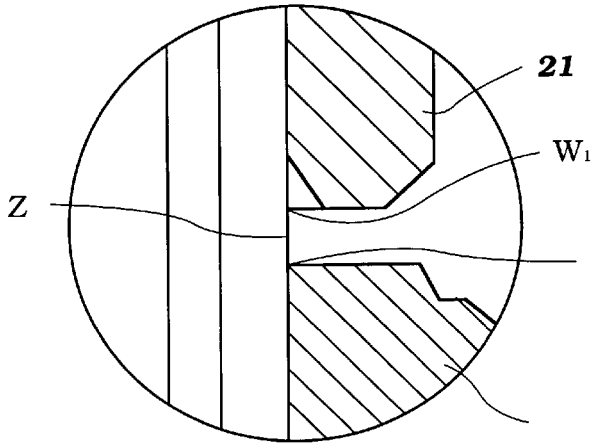
Figure 3 Prior Art
FIG. 3 (Prior Art) is an enlarged cross-sectional view of the area encircled in FIG. 2.
Figure 4:
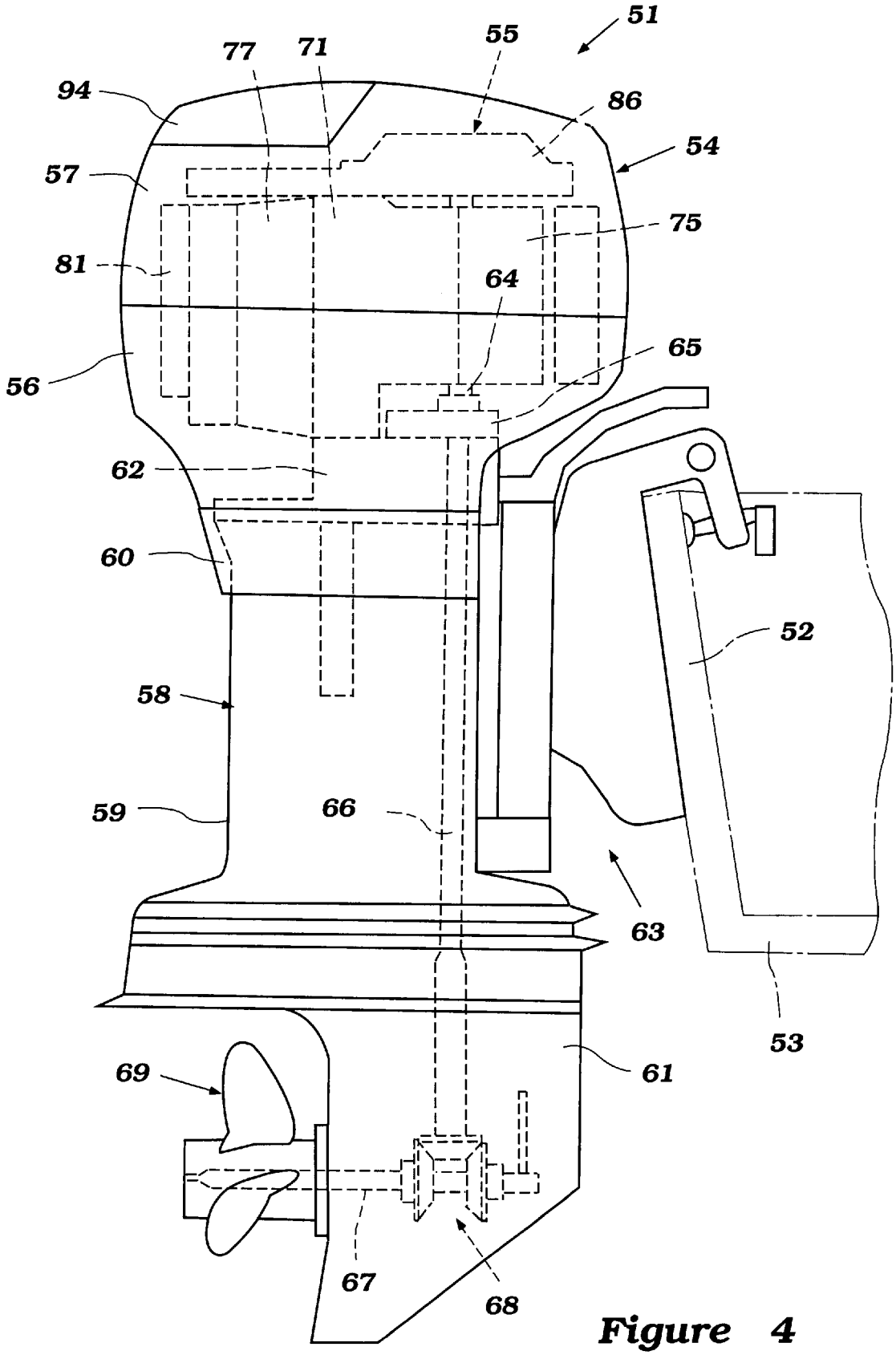
FIG. 4 is a side elevational view of an outboard motor constructed in accordance with an embodiment of the invention, shown attached to the transom of an associated watercraft which is shown partially in cross-section and in phantom.

Referring now in detail to the drawings and initially to FIG. 1, an outboard motor embodying the invention is identified generally by the reference numeral 51 and is shown as attached to the transom 52 of a watercraft hull. The hull is shown partially in cross-section and in phantom and is identified by the reference numeral 53.

The outboard motor 51 is comprised of a powerhead, indicated generally by the reference numeral 54 that is comprised of a powering internal combustion engine, indicated generally by the reference numeral 55 and surrounded by a protective cowling. This cowling includes a lower cowling member 56 and an upper cowling member 57 that is detachably connected to the lower cowling member 56 in a suitable manner.

A skirt portion 60 is provided below the lower cowling member 56 and encircles the upper portion of a driveshaft housing lower unit assembly, indicated generally by the reference numeral 58. This unit 58 includes a driveshaft housing portion 59 to which a lower unit housing portion 61 is affixed.

The engine 55 is supported upon a support or guide plate 62 that is mounted at the upper side of the driveshaft housing portion 59 and which extends partially upwardly into the lower portion of the lower cowling member 56.

A clamping, swivel bracket assembly, indicated generally by the reference numeral 63, is provided between the driveshaft housing portion 56 and the transom 52 of the watercraft 53. This assembly 63 includes a steering assembly for steering of the outboard motor 51 about a vertically extending axis and tilt and trim arrangement for trimming of the outboard motor about a horizontally extending axis. These mechanisms are well known in the art, and for that reason, further description of them is not believed to be necessary to permit those skilled in the art to practice the invention.

The construction of the engine 55 will be described in more detail shortly be reference to the remaining figures. However, it is mounted in the powerhead 54 upon the guide plate 62 so that its crankshaft, indicated at 64, rotates about a vertically extending axis. This is done so as to facilitate connection, in a manner which will be described in more detail later, to an oil pump 65 for driving the oil pump and to a driveshaft 66.

The driveshaft 66 depends into the driveshaft housing and lower unit assembly 58 and terminates in the lower unit outer housing 61. There it drives a propeller shaft 67 through a conventional bevel gear type reversing transmission 68 for driving a propulsion device for the watercraft such a propeller 69.

Figure 5:
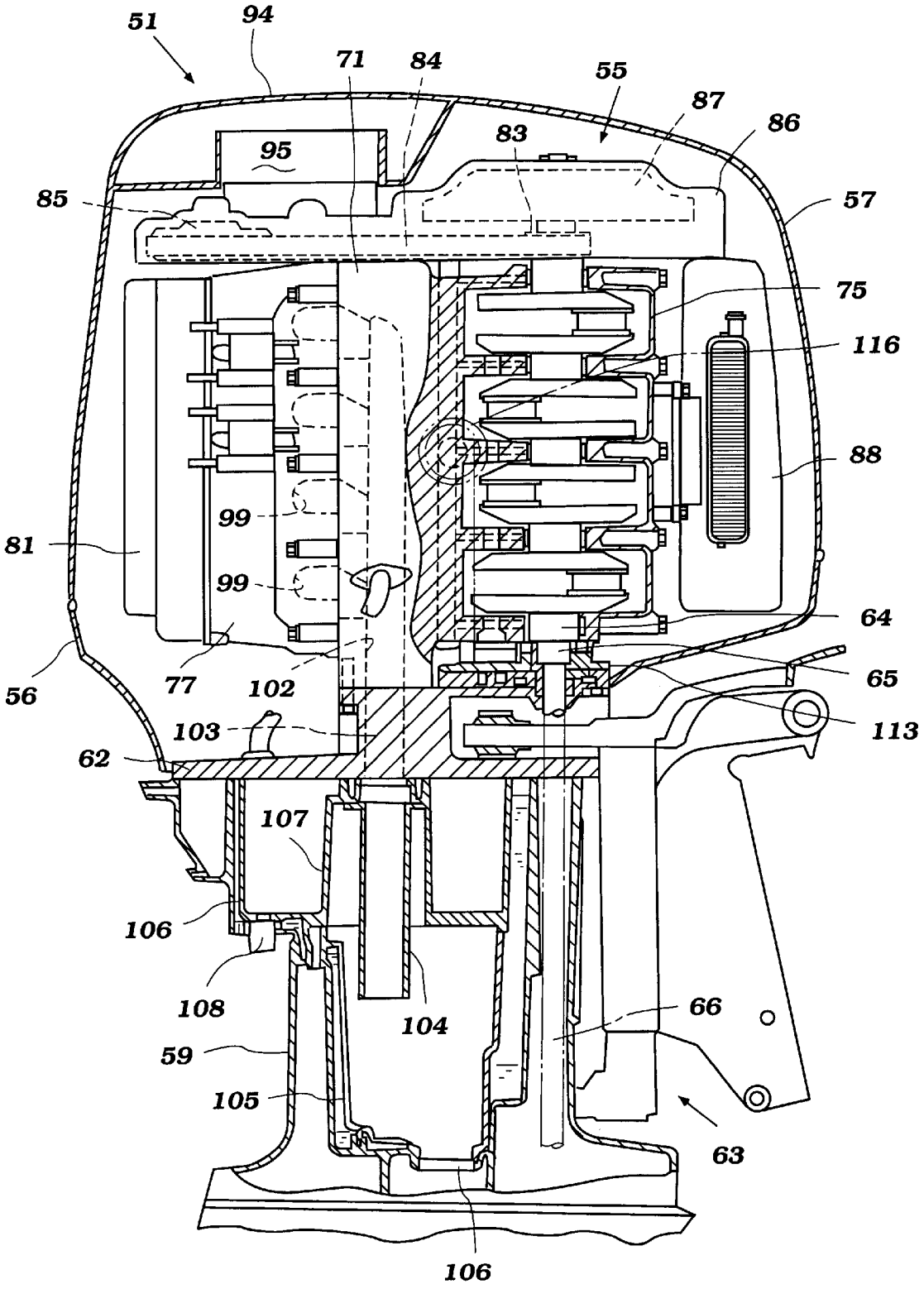
FIG. 5 is an enlarged, side elevational view of the powerhead of the outboard motor with a protective cowling broken away and portion of the engine and of the upper portion of driveshaft housing broken away and shown in section.
Figure 6:
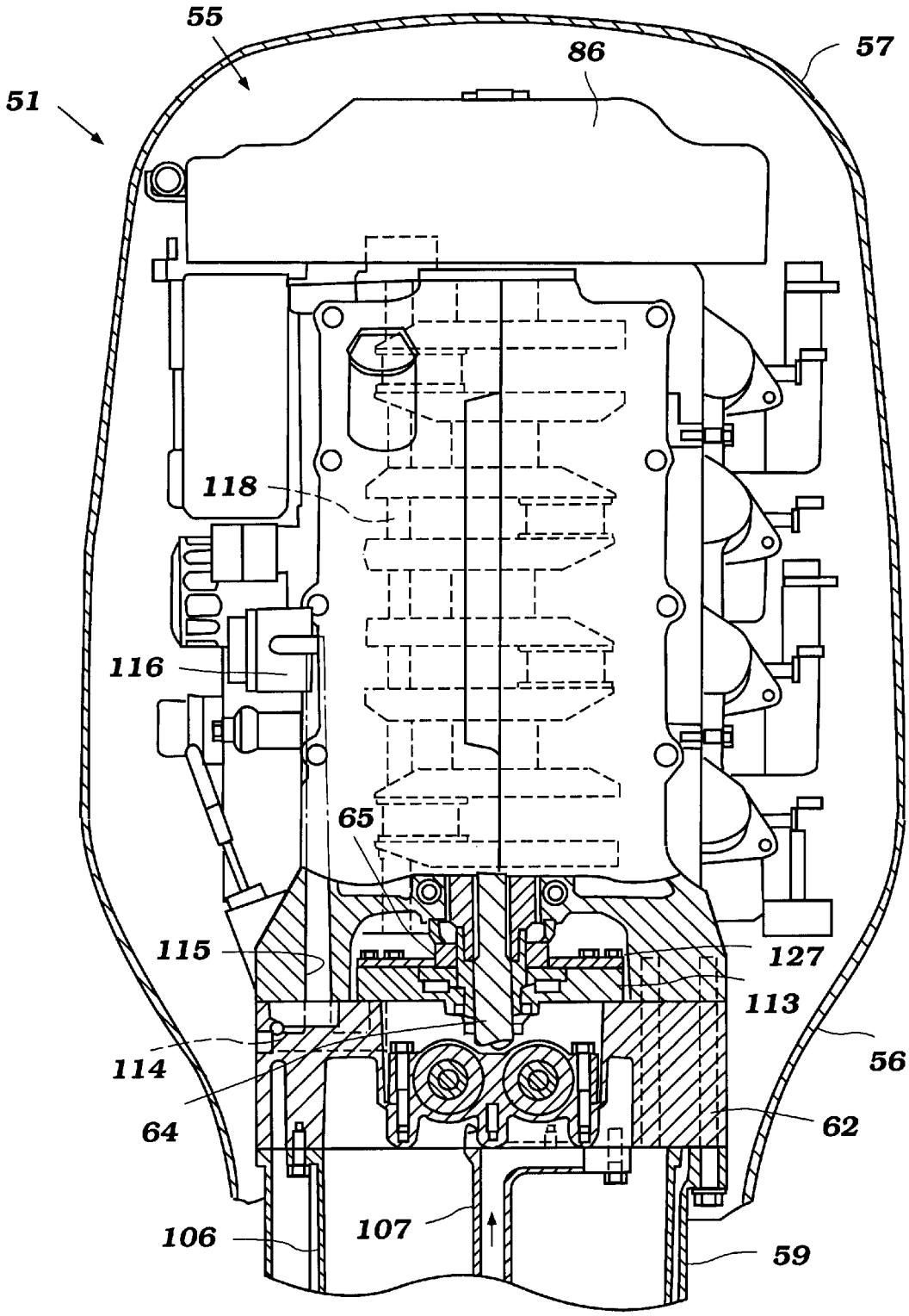
FIG. 6 is an enlarged, front elevational view of the component shown in FIG. 5 showing the protective cowling again in cross-section and a portion of the lower part of the engine and the upper portion of the driveshaft housing in cross-section.
Figure 7:
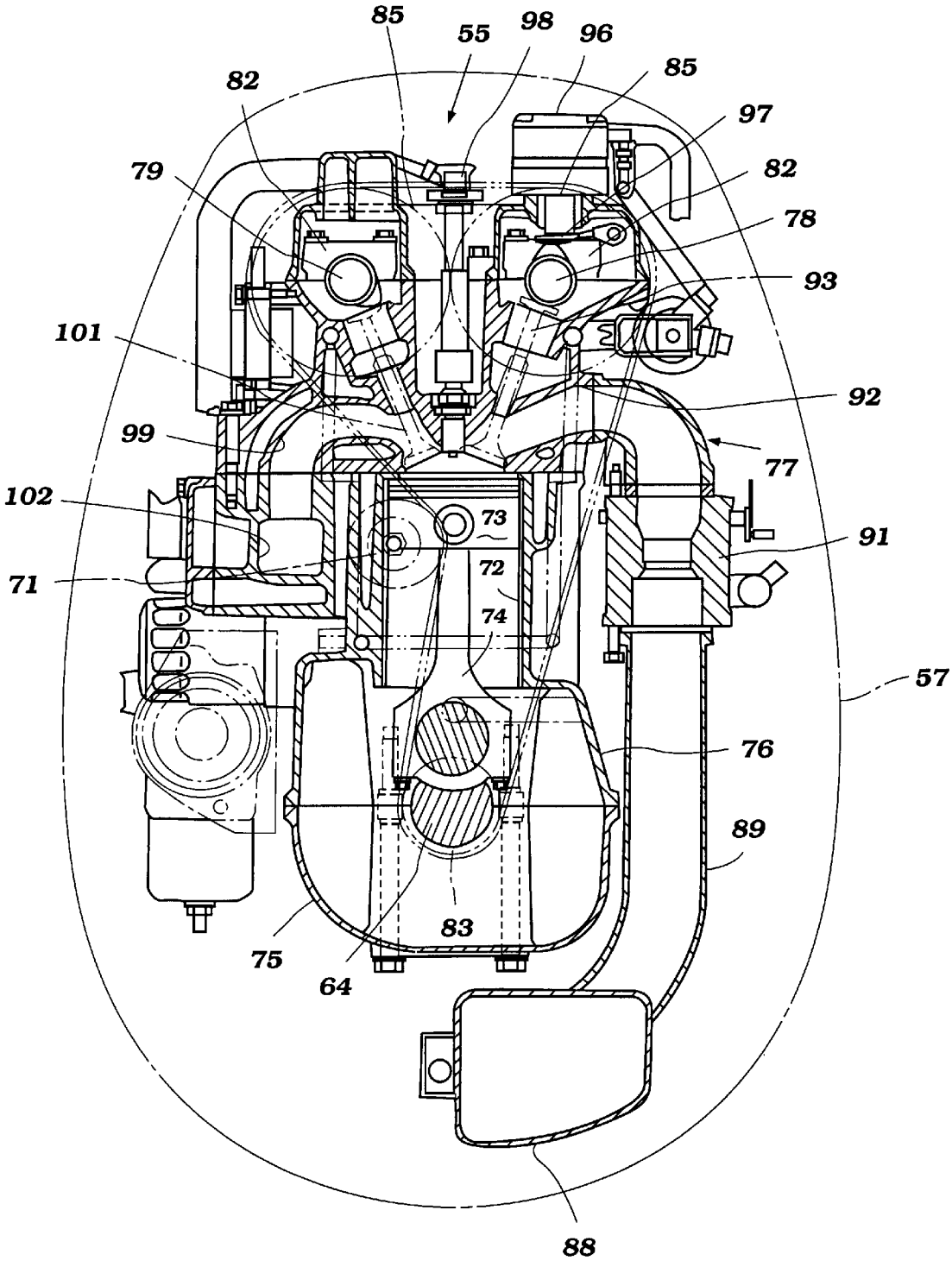
FIG. 7 is a top plan view of the powerhead of the outboard motor showing the surrounding protective cowling in phantom and the engine in cross-section.

The construction of the engine 55 will now be described referring in primary detail to FIGS. 5–7. The engine 55 is, in the illustrated embodiment, of the four cylinder, inline type and operates on a four stroke principal. Although the invention is described in conjunction with an engine having such a number of cylinders and such a configuration, it will be readily apparent to those skilled in the art how the invention can be practiced with engines having other cylinder numbers and other cylinder placement.

The engine 55 is comprised of a cylinder block 71 that forms four horizontally extending, vertically spaced, cylinder bores 72. Piston 73 reciprocate in the cylinder bores and are connected by connecting rods 74 to the throws of the crankshaft 64. The crankshaft 64 is journal for rotation within a crankcase chamber that is formed by a crankcase member 75 and the skirt 76 of the cylinder block 71 to which it is affixed.

A cylinder head assembly, indicated generally by the reference numeral 77, is affixed to the end of the cylinder block 71 opposite that closed by the crankcase member 75. The cylinder head assembly 77 may be of any known type and is depicted as being of the twin overhead cam shaft type.

This is comprised of an intake cam shaft 78 and an exhaust cam shaft 79 that are journaled within a cam shaft cavity formed by the cylinder head 77 and a cam shaft cover 81 that is affixed thereto. The cam shafts 78 and 79 are journaled in the cylinder head assembly by means that include bearing caps 82.

A timing drive comprised of a driving sprocket 83, which is affixed to the crankshaft 64 and specifically the upper end thereof, is provided for driving the cam shafts 78 and 79 in timed relationship to the crankshaft 64 at one-half its rotational speed. The sprocket 83 drives a drive belt or chain 84 which, in turn, cooperates with sprockets 85 fixed to the upper ends of the intake and exhaust cam shafts 78 and 79 in a known manner. A timing cover 86 encloses this timing drive mechanism as well as a flywheel magneto 87 that is driven off of the upper end of the crankshaft 64.

An induction and charge forming system supplies an air and fuel charge to the combustion chambers formed by the cylinder head assembly 77, pistons 73 and cylinder bores 72. The induction system is comprised of a plenum chamber or a surge tank 88 that is positioned adjacent the crankcase member 75 and which has a plurality of runner sections 89 that extend to throttle bodies 91. The throttle bodies 91 have throttle valves which are not shown but which are controlled in a suitable manner for controlling the speed of the engine 55.

The throttle bodies 91 cooperate with intake passages 92 formed in the cylinder head assembly so as to deliver the charge to the combustion chambers of the engine. The flow of the charge into the combustion chambers is controlled by intake valves 93 that are operated by the lobes of the intake cam shaft 78 in a known manner.

The air for the induction system is supplied to the interior of the protective cowling through an inlet opening formed in the outer cowling by a cover member 94 that defines an intake chamber that communicates with the interior of the cowling through a tuned inlet opening 95.

Fuel is supplied to the inducted air by a suitable charge forming system. This may comprise either a carburetor or carburetors or fuel injectors which can inject either directly into the combustion chambers or into the intake passages of the induction system. This fuel is supplied by means of a fuel pump 96 that is driven off of lobes of the intake cam shaft 74 by means of a rocker arm assembly 97.

The admitted charge is ignited by spark plugs 98 that are mounted in the cylinder head assembly 77 and which are fired by a suitable ignition system.

The ignited charge bums and expands to drive the engine 55. The burnt charge then is exhausted through exhaust passages 99 formed in the cylinder head assembly 77 on the side opposite the intake passages 92. These exhaust passages 99 are valved by exhaust valves 101 that are controlled by the exhaust cam shaft 79 in a known manner.

The cylinder head exhaust passages 99 communicate with an exhaust manifold 102 that is formed integrally within the cylinder block 71. The exhaust manifold 102 extends downwardly and communicates with an exhaust passage 103 formed in the guide plate 62.

An exhaust pipe 104 is affixed to the underside of the guide plate 62 and cooperates with an expansion chamber formed by an inner shell 105 of the driveshaft housing 59. This inner shell has a discharge opening 106 that communicates with a suitable exhaust system for discharging the exhaust gases to the atmosphere.

Figure 8:
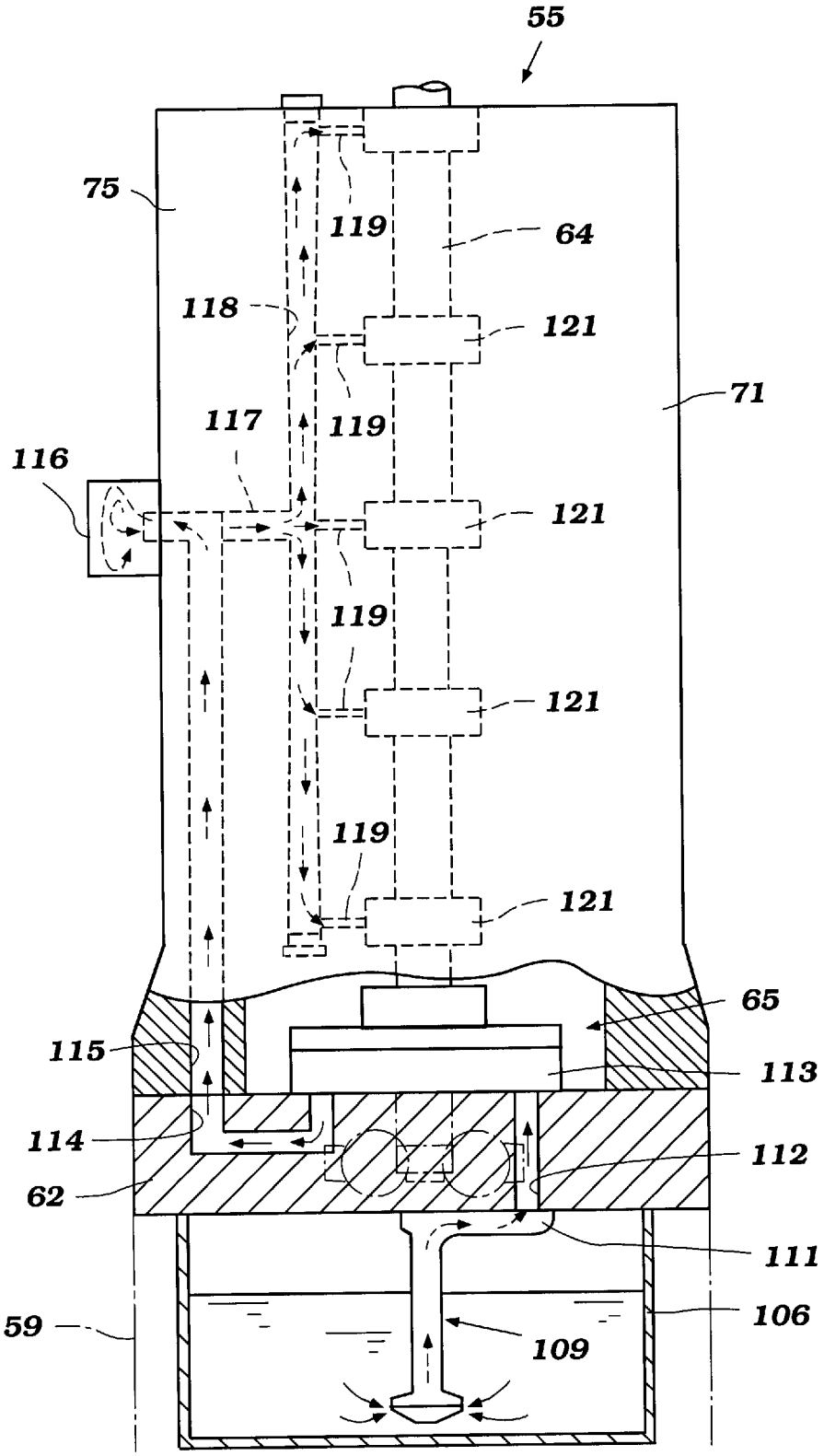
FIG. 8 is a partially schematic view of the lubricating system for the engine, with a portion broken away and shown in section.
Figure 9:
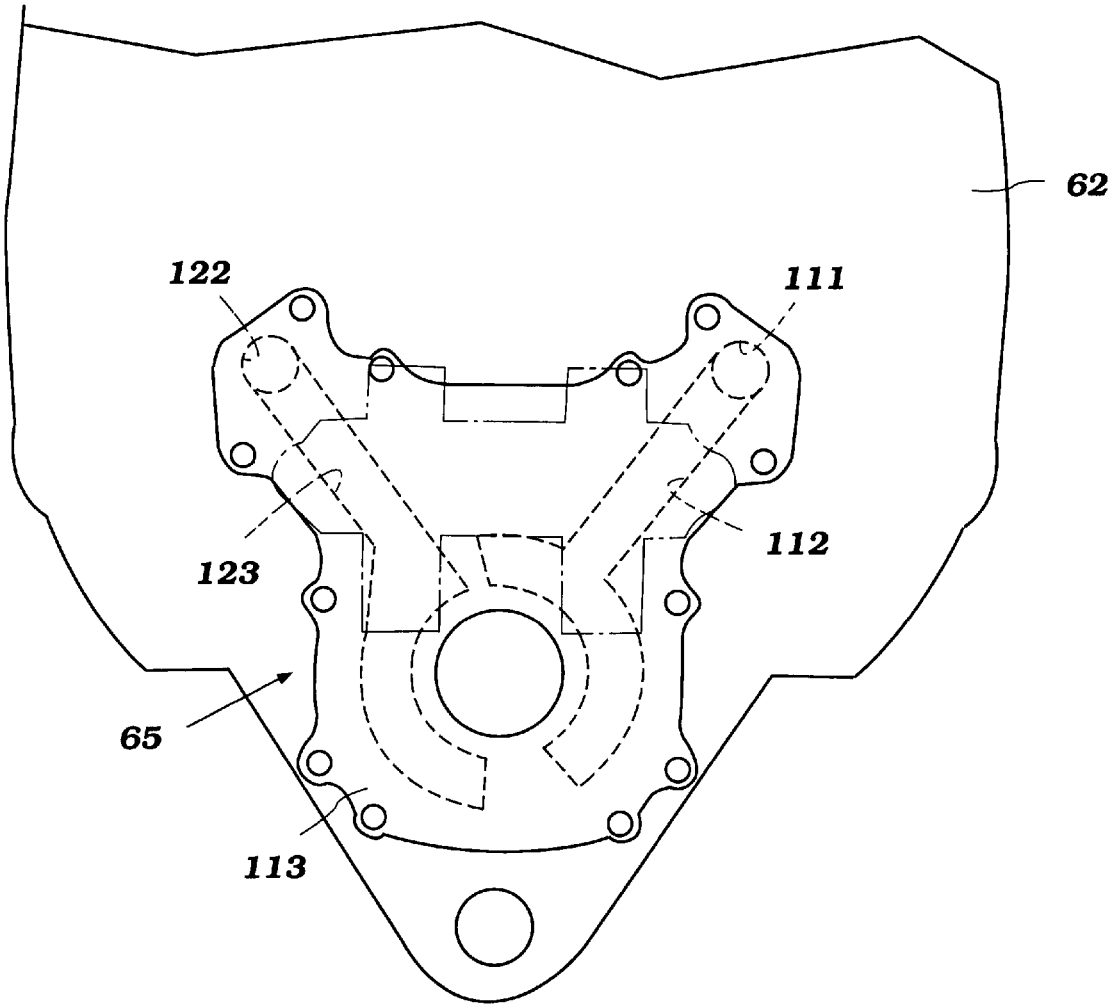
FIG. 9 is a top view of the exhaust guide and oil pump showing the lubricant flow paths.

The engine 55 is provided with a lubricating system which, as has been noted, includes the oil pump 65. This lubricating system will be described by reference to FIG. 8 in addition to FIGS. 5–7.

The lubricating system includes a lubricant or oil tank 106 that is mounted on the underside of the guide plate 102 and which has a central opening defined by inner wall 107 which surrounds the exhaust pipe 104 and forms an upper extension of the expansion chamber defined by the shell 105. This oil tank 106 has a suitable external drain 108 by which the oil may be discharged to the outside of the outboard motor 51 for servicing purposes.

A pickup tube 109 depends into the oil tank 106 and cooperates with a fitting 111 which, in turn, communicates with a supply passage 112 formed in the guide plate 62 and which extends upwardly to an opening in an outer member 113 of the housing of the oil pump 65. The oil pump 65 is of the gerotor type and its components will be described later primarily by reference to FIGS. 10–14.

The oil that is pressurized by the pump 65 is delivered to a delivery passage 114 which is also formed in the guide plate 62. This passage114 communicates with vertically extending main oil passage 115 that extends upwardly through the crankcase member 75 and which flows into the inlet fitting of a detachable oil filter 116 that is mounted on the crankcase member 75 in an easily accessed position at one side thereof.

Oil that has passed through the filter 116 flows through a supply passage 117 to a main oil gallery 118 that is formed in the crankcase member 75. This main oil gallery 118 has branch passages 119 which extend to the main bearings 121 for the crankshaft 64. These main bearings 121 are formed by the cylinder block and by the crankcase member75.

In addition, other oil galleries (not shown) supply oil to the cam mechanism and cam shafts as well as any other components of the engine that are to be pressure lubricated. The oil is then drained and returned through return passages back to the oil pan 106 in any suitable manner. This includes a return passage 122 and drain line 123 that are formed in the pump housing 113.

Figure 10:
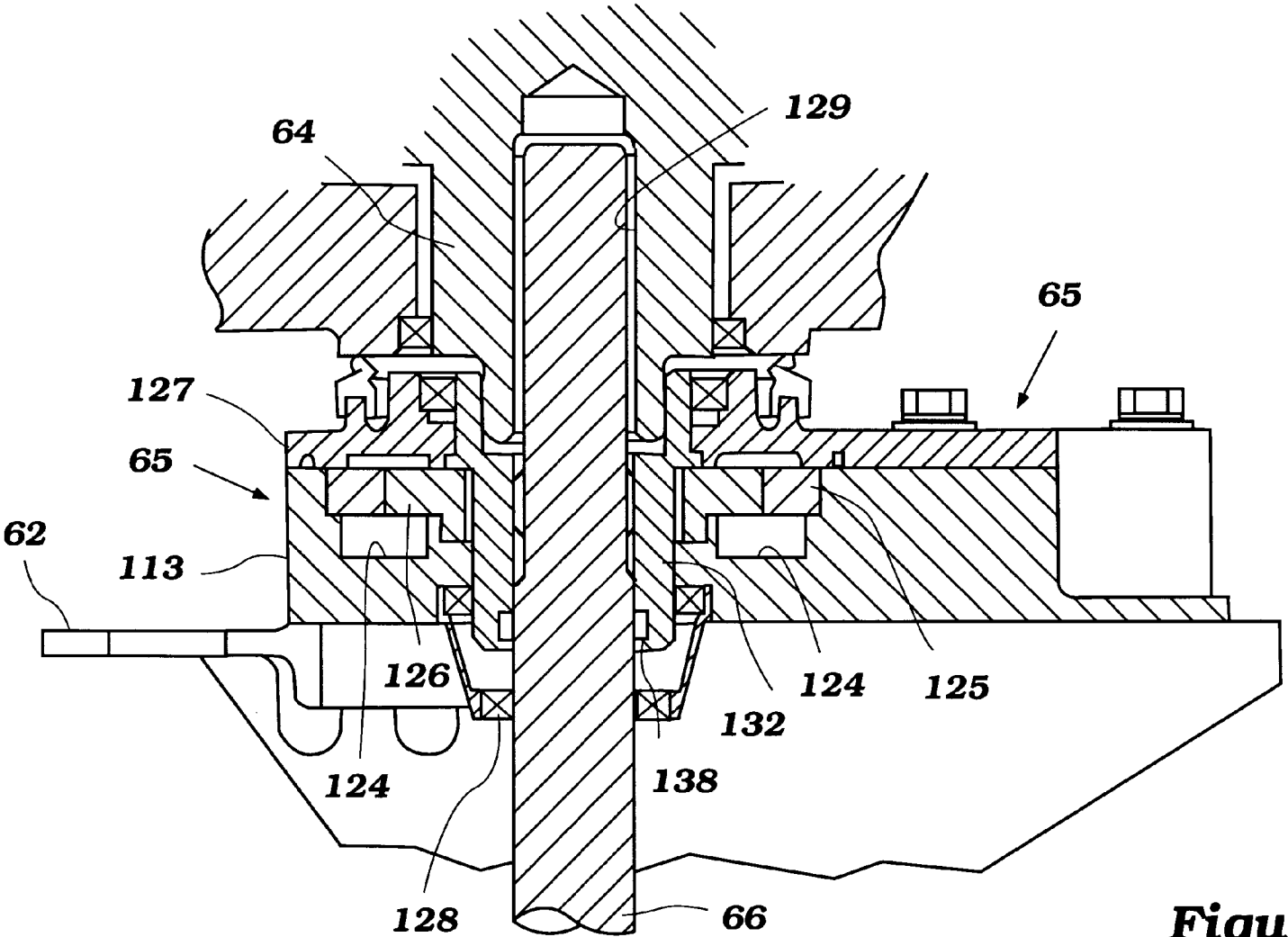
FIG. 10 is a cross-sectional view, in part similar to FIG. 1 but shows the corresponding connection between the crankshaft oil pump and driveshaft in accordance with the invention.
Figure 11:
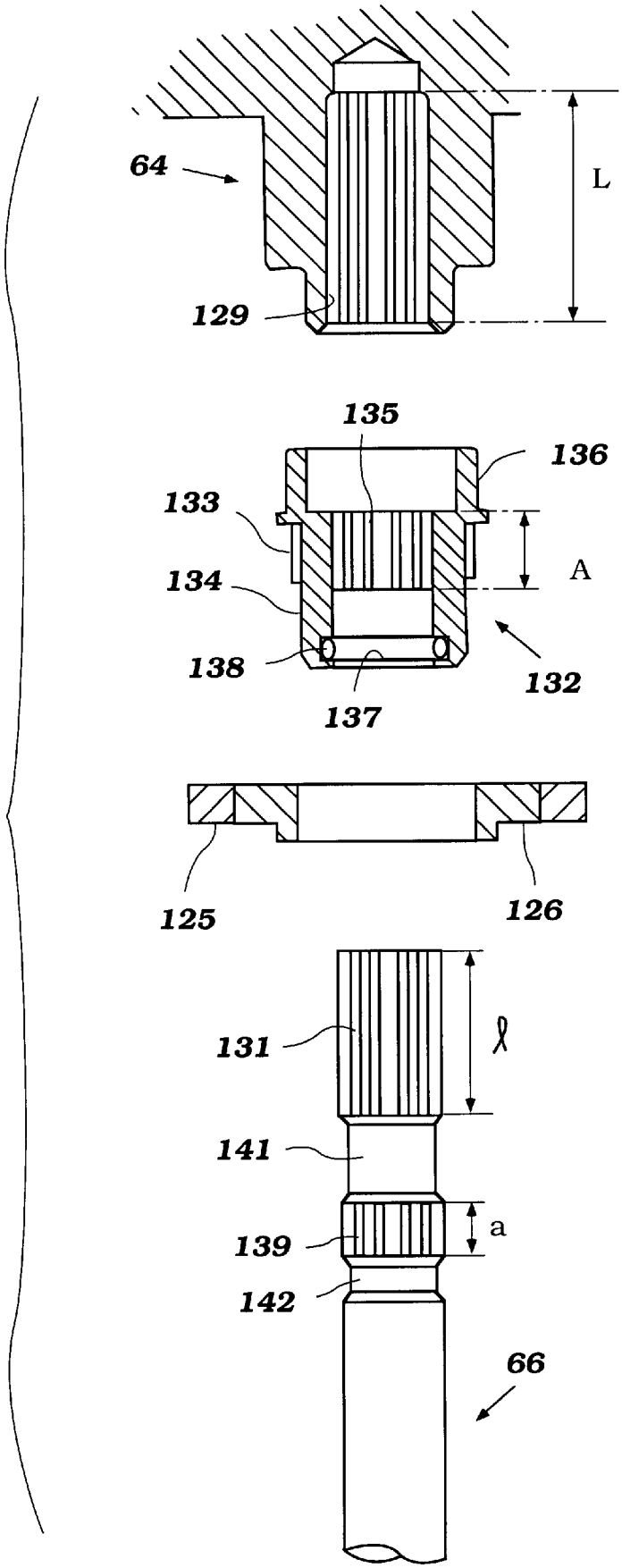
FIG. 11 is an exploded view of the assembly shown in FIG. 10 and specifically the splined connections thereof.
Figure 12:
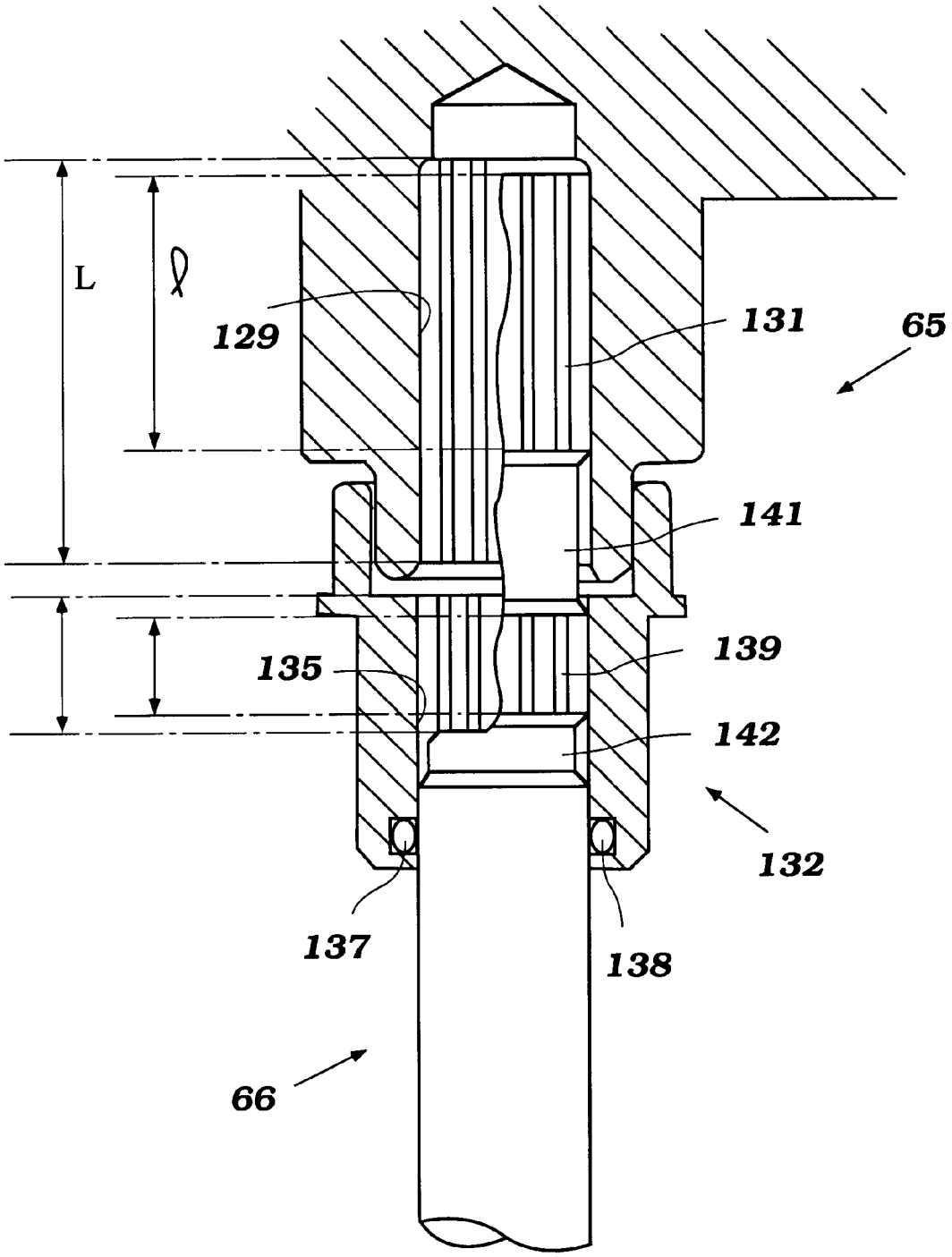
FIG. 12 is an enlarged cross-sectional view of the splined connection shown in FIG. 10 but illustrating in more detail the geometric relationship of the splined portions.

The construction of the oil pump 65 will now be described in detail by particular reference to FIGS. 10–14 with the pump assembly shown best in FIG. 10 being described first. As has been noted, the pump assembly 65 is mounted on the guide plate 62 and includes an outer housing 113. This outer housing 113 defines a pumping cavity 124 in which an outer, fixed gear 125 and a rotatable inner driven gear 126 are positioned.

As noted, the pump is of the gerotor type and the pumping action between the inner and outer gears 126 and 125 draws fluid into the pumping chamber 124 and discharges it through the pressure outlet already described. A cover plate 127 is affixed to and closes the upper side of the pump cavity 124.

The driveshaft 66 extends upwardly through an oil seal 128 mounted on the underside of the pump housing 113. The upper end of the driveshaft 66 extends into a cavity formed in the nose of the crankshaft 64.

The crankshaft 64 is provided with an internal female splined portion 129 that has a length L which is equal to or slightly greater than the length 1 of a spline portion 131 formed at the upper end of the driveshaft 66. The internal splines 129 of the crankshaft 64 terminates slightly above their lower face. Hence, the splines 131 and 129 are in continuous engagement and there are no splines that extend through unsplined portions so as to cause stress risers.

A pump driving element 132 is mounted so that it extends partially above the pump cover 127 and slightly below the lower face of the pump housing 113. This pump drive member 132 has a driving portion 133 on its outer surface that is engaged with a corresponding driving portion on the inner gear 126 to provide a driving relationship with the inner, pumping gear 126 of the pump 65.

This pump drive member 132 also has a cylindrical portion 134 which is partially coextensive with the driving portion 133 and in which female splines 135 are formed at a length A. An unsplined portion 136 extends upwardly of this portion and partially around the lower end of the crankshaft 64 as clearly seen in FIGS. 10 and 12.

A groove 137 is formed on the lower portion of the drive member 132 at the lower terminus of the portion 134. An o-ring seal 138 is received therein for sealing engagement with an unsplined portion of the driveshaft 66.

Spaced from the spline portion 131 of the driveshaft 66 is a second spline portion 139 which is spaced from the spline portion 131 by a reduced diameter cylindrical portion 141. The splines 139 have a length a which is equal to or slightly less than the length a of the splines 135 of the pump drive member 132. Again, therefore, the splines 139 and 135 will be in substantially full engagement therewith with each other and there will be thus no stress risers formed.

The area below the splines 139 is provided with a reduced diameter portion 142 so as to again avoid stress raisers.

Figure 13:
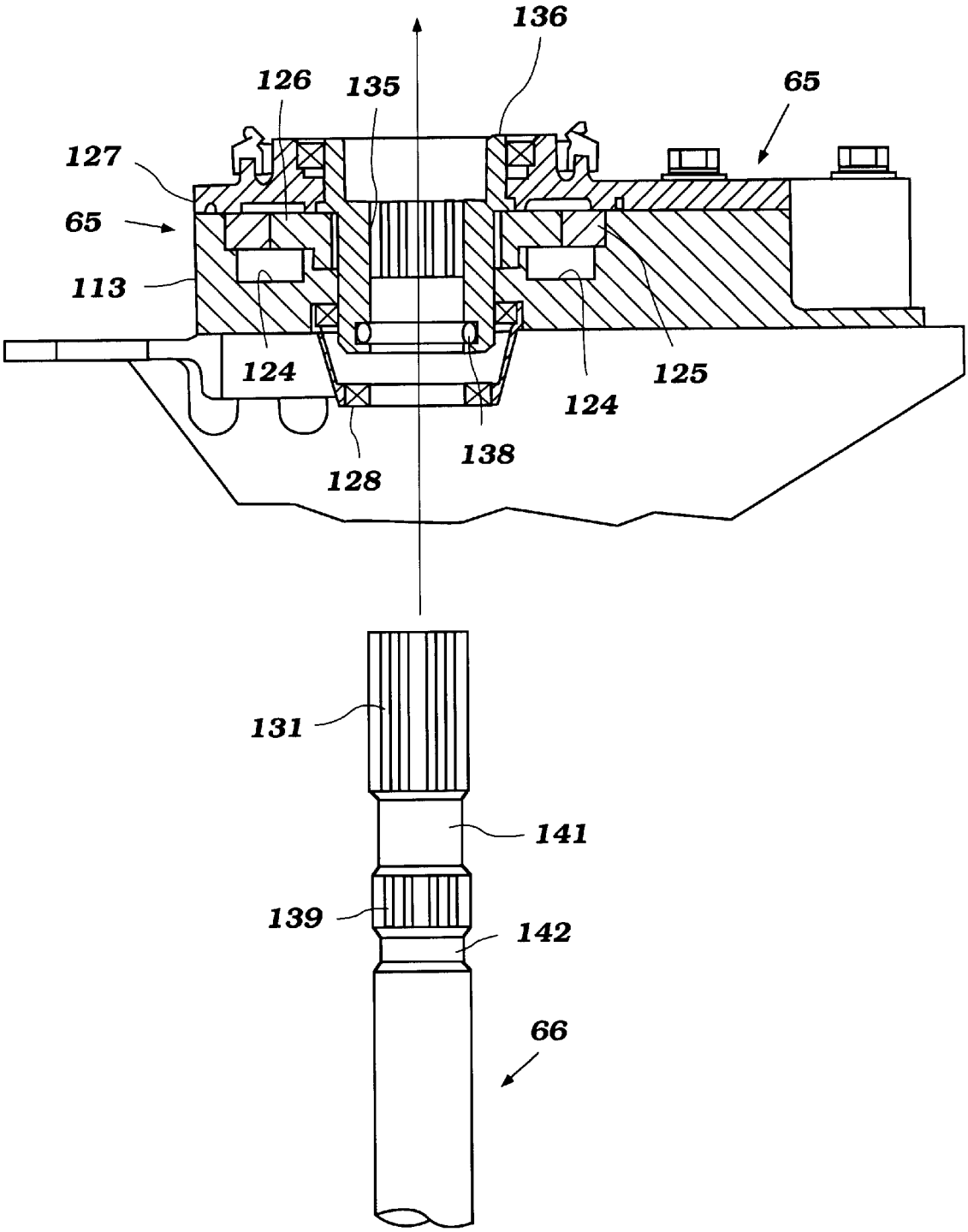
FIG. 13 is a partially assembled view showing how the guide plate and oil pump are inserted onto the driveshaft housing.
Figure 14:
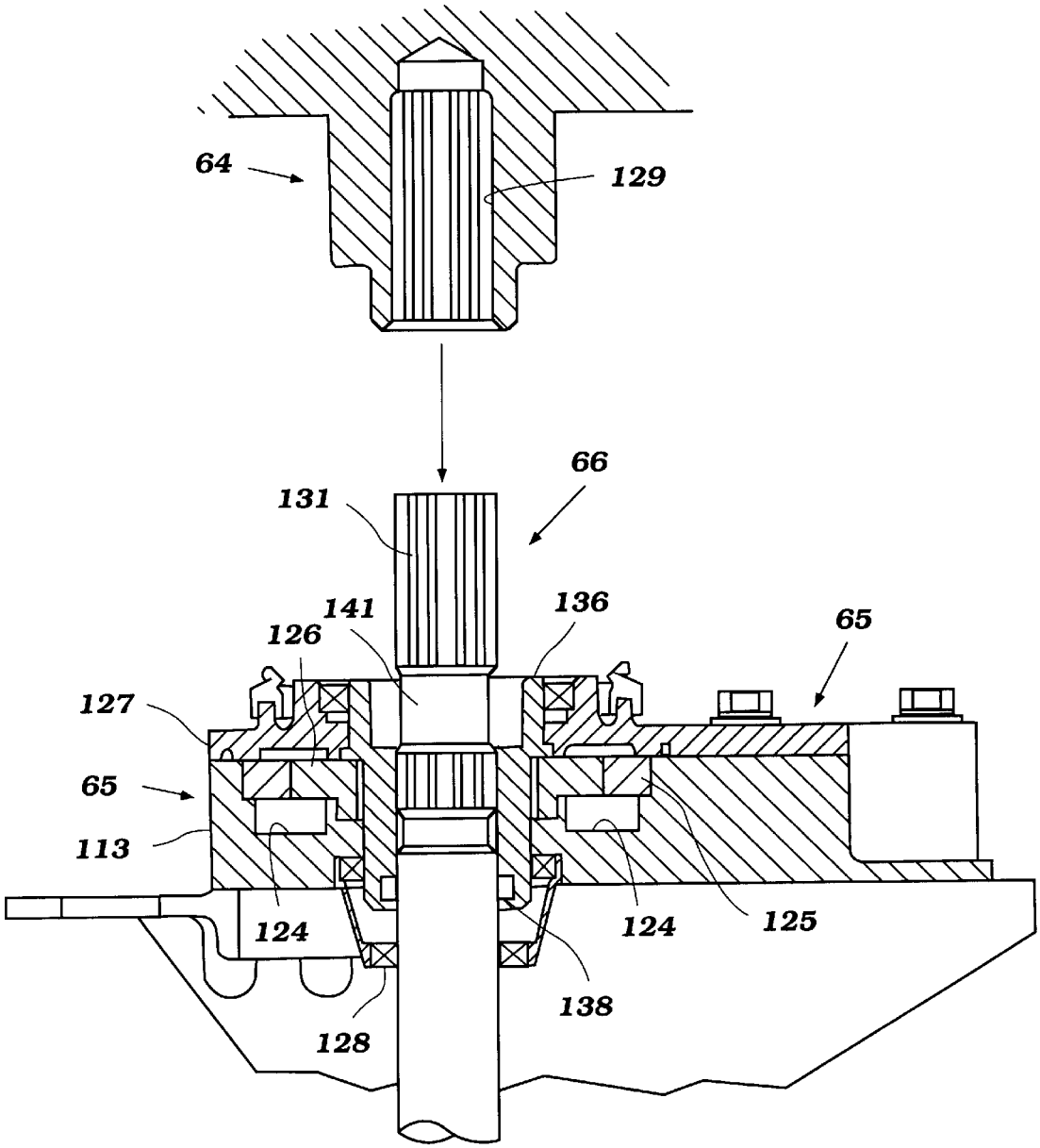
FIG. 14 is an exploded view showing the components of FIG. 13 assembled and the engine in place for assembly upon the guide plate.

Thus, the assembly can be easily put together and removed in the manner that will become apparent by reference to FIGS. 13 and 14. First, once the driveshaft 64 is in position, the guide plate 62 with the assembled pump 65 on it is slid into place by moving it in a downward direction.

After this, the engine 55 can then be installed on top of this as seen in FIG. 14 so that the spline connections are completed. Thus, the assembly is very easy to assemble and disassemble. Furthermore, even if there are large deflections in the shafts due to torsional loadings, the splines 131 and 129 and 139 and 135 will always be in full engagement and will not be deformed. Thus, even if there is a permanent deformation in the driveshaft the pump mechanism can be easily disassembled for servicing.

Thus, it should be readily apparent that the objects of the invention are well met and a robust simple and very compact pump drive assembly is provided in accordance with the invention.

Of course, the foregoing description is that of a preferred embodiment of the invention and various changes and modifications may be made without departing from the spirit and scope of the invention, as defined by the appended claims.

What is claimed is:

1. An outboard motor oil pump and drive arrangement for a lubricating system of the engine that propels the water propulsion device of said outboard motor, said outboard motor having a powerhead comprised of a powering four cycle internal combustion engine and a surrounding protective cowling, and a driveshaft housing and lower unit depending from said powerhead and containing said water propulsion device, said engine being positioned in said powerhead so that a crankshaft of said engine rotates about a vertically disposed axis, a driveshaft depending into said driveshaft housing and lower unit for driving said water propulsion device, said engine lubricating system includes an oil pan that is positioned below said engine, said oil pump being positioned below said engine and above said oil pan, said oil pump having a drive element for driving said oil pump, a first spline connection formed between said crankshaft and said driveshaft for driving said driveshaft from said crankshaft, and a second spline connection between said crankshaft and said drive element for driving said oil pump from said crankshaft, said first and said second spline connections comprise a pair of axially spaced apart spline sets formed on one of said crankshaft and said driveshaft and separated by a non-splined portion thereof.

2. An outboard motor as set forth in claim 1, wherein the first spline connection for driving the driveshaft is formed by inter-engaging splines on the driveshaft and on the crankshaft.

3. An outboard motor as set forth in claim 1, wherein the second spline connection for driving the pump drive element is formed by inter-engaging splines on the driveshaft and on the pump drive element.

4. An outboard motor as set forth in claim 3, wherein the first spline connection for driving the driveshaft is formed by inter-engaging splines on the driveshaft and on the crankshaft.

5. An outboard motor as set forth in claim 1, wherein the non-splined portion separating the spline sets has a smaller diameter than the spline sets.

6. An outboard motor as set forth in claim 5, wherein the diameter of the non-splined portion separating the spline sets is not greater than the root diameter of the spline sets.

7. An outboard motor as set forth in claim 1, wherein the length of the male member of at least one of the spline connect is not greater than the female member of said one spline connections.

8. An outboard motor as set forth in claim 7, wherein the length of the male member of both of the spline connections is not greater than the female member of the respective spline connection.

9. An outboard motor as set forth in claim 1, wherein the driveshaft is the common member that forms the axially spaced splines sets of the first and second spline connections.

10. An outboard motor as set forth in claim 9, wherein the first spline connection for driving the driveshaft is formed by inter-engaging splines on the driveshaft and on the crankshaft.

11. An outboard motor as set forth in claim 9, wherein the second spline connection for driving the pump drive element is formed by inter-engaging splines on the driveshaft and on the pump drive element.

12. An outboard motor as set forth in claim 10, wherein the first spline connection for driving the driveshaft is formed by inter-engaging splines on the driveshaft and on the crankshaft.

13. An outboard motor as set forth in claim 12, wherein the non-splined portion separating the spline sets has a smaller diameter than the spline sets.

14. An outboard motor as set forth in claim 13, wherein the diameter of the non-splined portion separating the spline sets is not greater than the root diameter of the spline sets.

15. An outboard motor as set forth in claim 14, wherein the length of the male member of at least one of the spline connections is not greater than the female member of said one spline connections.

16. An outboard motor as set forth in claim 15, wherein the length of the male member of both of the spline connections is not greater than the female member of the respective spline connection.

17. An outboard motor as set forth in claim 16, further including a non-splined portion formed on driveshaft below its lowermost spline set that has a smaller diameter than said lowermost spline set and the portion of said driveshaft below said non-splined portion.

* * * * *